US005461658A

United States Patent [19]

Joosten

[11] Patent Number: 5,461,658

[45] Date of Patent: Oct. 24, 1995

[54] X-RAY EXAMINATION APPARATUS

[75] Inventor: Johannes H. M. Joosten, Eindhoven, Netherlands

[73] Assignee: U.S. Philips Corporation, New York, N.Y.

[21] Appl. No.: 229,502

[22] Filed: Apr. 19, 1994

[30] Foreign Application Priority Data

May 21, 1993 [EP] European Pat. Off. ..... 93201460

[51] Int. Cl.[6] ..... H05G 1/64

[52] U.S. Cl. ..... 378/98.7; 378/98.3

[58] Field of Search ..... 378/98.7, 98.3

[56] References Cited

U.S. PATENT DOCUMENTS 4,809,309 2/1989 Beekmans ..... 378/99

5,164,583 11/1992 Aichinger ..... 378/98.7

FOREIGN PATENT DOCUMENTS 0217456 4/1987 European Pat. Off. .

*Primary Examiner*—Craig E. Church

*Attorney, Agent, or Firm*—Jack D. Slobod

[57] ABSTRACT

An x-ray examination apparatus is provided with an auxiliary light-detection system for performing brightness control of a visible image produced on the exit screen of the x-ray image intensifier. The auxiliary light-detection system includes a photosensor having a wide dynamic range and a photodetector having a multitude of photosensitive elements so as to provide spatial resolving power. In particular the photodetector is a charge-coupled device (CCD-detector) having an inherently limited dynamic range. Brightness-control, notably avoiding overexposure in certain regions, is carried out by assembling relevant pixel-values of parts of the image into a control signal. The sensitivity of the CCD-sensor is adjusted by employing of the signal of the photosensor and a sensitivity-control device. Therefore, the sensitivity of the light-detection system is made to match the dynamic range of images due to a collection of x-ray exposures. In order to obtain a control signal that is optimized to relevant pans of the visible image and being independent of average brightness over the entire area of an image, the signal produced by the CCD-detector, that is reciprocal to the average brightness, is multiplied by the signal of the photosensor, that is proportional to the average brightness.

20 Claims, 2 Drawing Sheets

X-RAY EXAMINATION APPARATUS

BACKGROUND OF THE INVENTION

1. Field of the Invention

The invention pertains to an x-ray examination apparatus including an x-ray source, an x-ray image intensifier for converting an x-ray image made by irradiating an object with an x-ray beam from the x-ray source into a visible image and an image detection device for detecting said visible image, the image detection device being provided with an auxiliary light-detection system for performing brightness-control for said visible image, which includes a photodetector for generating a photodetector signal.

2. Description of the Related Art

An x-ray examination apparatus of said kind is known from the European Patent Application EP 0 217 456 which corresponds to U.S. Pat. No. 4,809,309.

The known x-ray examination apparatus is fitted with an auxiliary light-detection system having a photodetector being a charge-coupled device (CCD-detector). Brightness-values in the visible image are converted into an electronic photodetector signal by the photodetector. An advantage of providing the auxiliary light detection system with a CCD-detector that has a multitude of photosensitive elements, is that a CCD-detector has spatial resolving power, so that brightness control is carried out using spatial information acquired by an auxiliary light-detection system as described in the cited reference. The auxiliary light-detection system employs the CCD-detector for producing an exposure-control signal for controlling exposure in the visible image, e.g. by adjusting the x-ray source. A CCD-detector, as incorporated in the known auxiliary light-detection system, however, inherently has a comparatively limited dynamic range of brightness for which it operates adequately. Within a single x-ray image the brightness-values may have a range of typically 15 dB, that is sufficiently limited for employing a CCD-detector in the auxiliary light-detection system. Within a single x-ray image the dynamic range remains limited due to reduction of contrast by scattering processes in the x-ray image intensifier. Among various x-ray images in a collection of x-ray images the average brightness-values appear to vary over a much wider range, typically 50 dB in practical examinations. Such a collection is formed e.g. either by making a sequence of x-ray exposures or by x-ray exposures made during various x-ray examinations each of them being performed at a different x-ray dose rate. Therefore, the use of a CCD-detector per se as a photodetector in an auxiliary light-detection system for brightness control has a drawback in that the range of sensitivity only limitedly matches the dynamical range of brightness of images in a collection of x-ray exposures.

SUMMARY OF THE INVENTION

It is inter alia an object of the invention to provide an x-ray examination apparatus with an auxiliary light-detection system having a sensitivity-range matching a wide dynamic range due to a collection of x-ray images.

To achieve this object, an x-ray examination apparatus in accordance with the invention is characterised in that the auxiliary light-detection system incorporates a photosensor for generating a photosensor signal being representative of an average brightness of the visible image, and a sensitivity-control device for converting said photosensor signal into a sensitivity-control signal for adjusting the sensitivity of the photodetector.

Part of the light emanating from the exit screen of the x-ray image intensifier is guided to the photosensor. Another part is guided to the photodetector, having a plurability of photosensitive elements, notably a CCD-detector. An electronic photosensor signal with a signal amplitude that is due to brightness averaged substantially over the area of the exit screen of the image intensifier is generated by the photosensor. The photosensor signal is converted into a sensitivity-control signal that is taken to the CCD-detector. The CCD-detector produces an electronic CCD-signal comprising pixel values due to brightness-values of the visible image. Thus, on the CCD-detector is displayed an, albeit reduced, representation of the visible image that is formed on the exit screen of the image intensifier. Brightness control of the visible image is performed on the basis of the CCD-signal. The integration-time of the CCD-detector is adjusted by means of the sensitivity-control signal depending on the average brightness of the visible image. In particular, the integration time is made longer when the brightness of the visible image is low. Additionally or alternatively, the sensitivity-control signal is employed for adjusting a pre-amplifier incorporated in the CCD-detector. Consequently, the sensitivity of the CCD-detector is increased, when the average brightness of the visible image becomes less. Therefore, the sensitivity of the auxiliary light-detection system is made to match a dynamic range of a collection of visible images that correspond to a collection of x-ray images.

A further advantage is that the auxiliary light-detection system is capable of performing brightness control both for x-ray fluoroscopy where a low x-ray-dose rate is administered for a prolonged time duration and for x-ray exposures where brief pulses of high x-ray dose rate are employed.

A preferred embodiment of an x-ray examination apparatus in accordance with the invention is characterised in that the auxiliary light-detection system comprises an image processor for convening said photodetector signal into a primary control signal for performing said brightness-control by performing imaging adjustments.

Brightness control often is required on the basis of brightness of the visible image, in particular of brightness in parts of the visible image. E.g. in cardioexaminations, avoiding overexposure is called for when imaging a heart which is surrounded by lung-tissue that is much more transparent for x-rays than the heart. To produce a primary control signal from image features in parts of the visible image from the CCD-signal an image processor is provided. The image processor assembles a primary control signal from pixel-values of a part at issue of the visible image.

A further preferred embodiment of an x-ray examination apparatus in accordance with the invention is characterised in that the sensitivity-control device incorporates a voltage-to-frequency converter and a timing generator.

The sensitivity-control signal is preferably produced from the photosensor signal by way of the combination of a voltage-to-frequency converter and a timing generator. The photosensor signal having the form of a voltage is taken to the voltage-to-frequency converter which supplies a digital sensitivity-control signal having a frequency due to the voltage of the photosensor signal. A timing generator is driven by said digital sensitivity-control signal so as to adjust the integration time of the CCD-detector for adapting the sensitivity of the CCD-detector to the average brightness of the visible image. Because adjustment of the CCD-detector can in this way be performed rapidly, in a x-ray examination apparatus in accordance with the invention brightness control an be employed both during fluoroscopy where a low x-ray dose rate is administered during a prolonged time as well as during pulsed x-ray exposures where high x-ray doses are successively administered during a brief period.

A further preferred embodiment of an x-ray examination apparatus in accordance with the invention is characterised in that the auxiliary light-detection system comprises multiplication means for forming an exposure-control signal for performing said brightness control, said exposure-control signal being formed by multiplying said primary control signal by said photosensor signal.

The adjustment of the sensitivity of the CCD-detector through the adjustment of the integration time of the CCD-detector results in a CCD-signal with an amplitude that is substantially independent of the average brightness of the image. As a result the CCD-signal only contains information about relative spatial intensity distribution within the visible image. This dependence arises because the sensitivity of the CCD-detector is adapted to said average brightness. The adjustment of the sensitivity of the CCD-detector through the adjustment of the integration time of the CCD-detector leads to a dependence of the primary control signal being substantially reciprocal to the photosensor signal amplitude. For performing brightness control however, it is preferred to employ a control signal that contains absolute information about the (spatial) intensity (distribution) within the image. A primary control signal is generated by the image processor representing spatially selected relevant information relative to average intensity within the visible image. To that end, an exposure-control signal (containing absolute information) is generated by multiplying the primary control signal by the photosensor signal, the latter being representative of the average brightness of the visible image.

A further preferred embodiment of an x-ray examination apparatus in accordance with the invention is characterised in that said multiplication means incorporates a digital-to-analog converter for converting said primary control signal into an analog control signal, and a voltage-to-frequency converter having a first input to which said analog control signal is taken, having a second input to which said photosensor signal is taken, having an output from which said exposure-control signal for performing brightness control is supplied.

The exposure-control signal is preferably produced from the primary control signal and the photosensor signal by way of a multiplication means incorporating a voltage-to-frequency converter having two input ports. The voltage due to the signal amplitude of the photosensor signal is supplied to the first input port of the voltage-to-frequency converter and the primary control signal is taken to the second input port. The voltage-to-frequency converter produces an exposure-control signal having a frequency being proportional to the product of the signal amplitudes of the photosensor and the primary control-signal, respectively. Thus, the exposure-control signal contains absolute intensity information for performing brightness control. The exposure-control signal only contains information of spatially selected relevant parts of the image.

A further preferred embodiment of an x-ray examination apparatus in accordance with the invention is characterised in that said apparatus is provided with a user-interface for supplying a field-selection signal to the auxiliary light-detection system.

For various medical examination procedures parts of the visible image that are relevant for brightness control are different. As an example, the relevant parts of the visible image in thorax-examinations where parts of lungs may be subjected to overexposure are different from relevant parts at issue during peripheral angiography where limbs are surrounded by air. Therefore, it is preferred that selection of measuring-fields, i.e. said relevant parts of the visible image, can be performed. To that end, a user-interface is provided for supplying field-selection signals to the image processor. At option measuring-fields can be selected automatically from a field memory or manually by way of a control means and a monitor displaying the visible image.

A further preferred embodiment of an x-ray examination apparatus in accordance with the invention is characterised in that the image processor is arranged for supplying image-control signals.

The electronic CCD-signal is representative of the visible image. From the electronic CCD-signal an image-control signal is formed by the image processor that is representative of the contrast of the visible image or of contours separating bright and dark portions in the visible image. The image-control signal is employed for controlling the x-ray source and the image detection device. Moreover, because the CCD-detector is adjusted rapidly, the generation of the image-control signal is completed within the duration of an x-ray exposure. Therefore, it is provided to perform brightness control during a brief x-ray exposure.

An image detecting system comprising an auxiliary light-detection system and being suitable for use in an x-ray examination apparatus in accordance with the invention preferably incorporates a photosensor for generating a photosensor signal and a sensitivity-control device for converting said photosensor signal into a sensitivity control signal for adjusting the sensitivity of the photodetector.

BRIEF DESCRIPTION OF THE DRAWING

These and other aspects of the invention will become apparent from and elucidated with reference to the embodiments described hereinafter and with reference to the accompanying drawing, wherein.

DETAILED DESCRIPTION OF THE PREFERRED EMBODIMENTS

Figure 1:
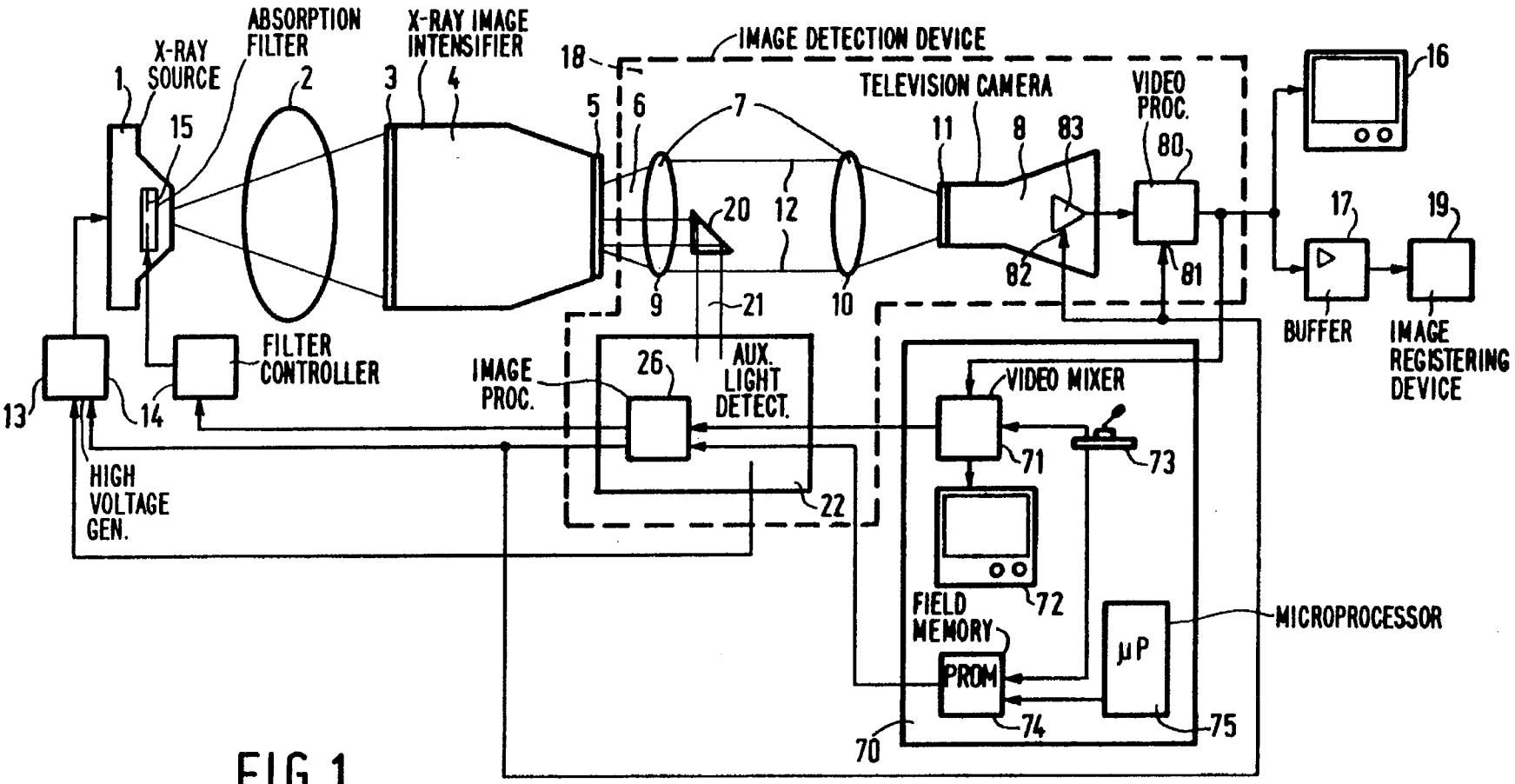
FIG. 1 shows a schematic diagram of an x-ray examination apparatus in accordance with the invention.

FIG. 1 shows a schematic diagram of an x-ray examination apparatus in accordance with the invention. By the x-ray source 1 an object 2 is irradiated and due to modulated absorption of x-radiation within the object an x-ray image is formed on the entrance screen 3 of the x-ray image intensifier 4. The x-ray image is convened by the x-ray image intensifier into a visible image which is formed on the exit screen 5 of the x-ray image intensifier. Said visible image is detected by the image detection device 18. The image carrying visible radiation 6 emanating from the exit screen 5 is, in the embodiment shown here, imaged with the aid of an optical arrangement 7 onto a television camera 8, which in turn converts the visible image into an electronic video signal. The optical arrangement 7 comprises a first lens 9 whose object focal plane coincides substantially with the exit screen 5, and a second lens 10 whose image focal plane substantially coincides with an image pick-up face 11 of the television camera 8.

The visible radiation 6 emanating from the exit screen of the x-ray image intensifier is formed into a parallel light-beam 12 by way of the lens 9, said parallel light-beam is subsequently focused by lens 10 onto the image pick-up face 11 of the television camera. In the space between the lenses 9 and 10 there is inserted an optical element 20, having the form of a prism with which e.g. 0.1 to 1 per cent of the luminous flux of the parallel beam 12 is deflected as a partial beam 21. The optical element 20 can also be formed by a mirror set at an angle to the parallel beam, and if desired be partially transparent, by a bundle of fibres etc. The partial beam 21 is detected by the auxiliary light-detection-system 22. Using the partial beam 21 as an input, the auxiliary light-detection system forms an exposure-control signal which is supplied to a high-voltage-generator 13 for controlling e.g. pulse-duration, intensity and energy of the x-radiation produced by the x-ray source. Additionally, the auxiliary light-detection system forms image-control signals in the form of contrast signal and a contour signal. Said contour signal is supplied to a filter controller 14 for controlling adjustment of an absorption filter 15, so as to avoid overexposure in parts of the visible image due to portions of the object having low x-ray absorption. Said contrast signal is supplied to the high-voltage generator 13 for controlling the x-ray source.

Figure 2:
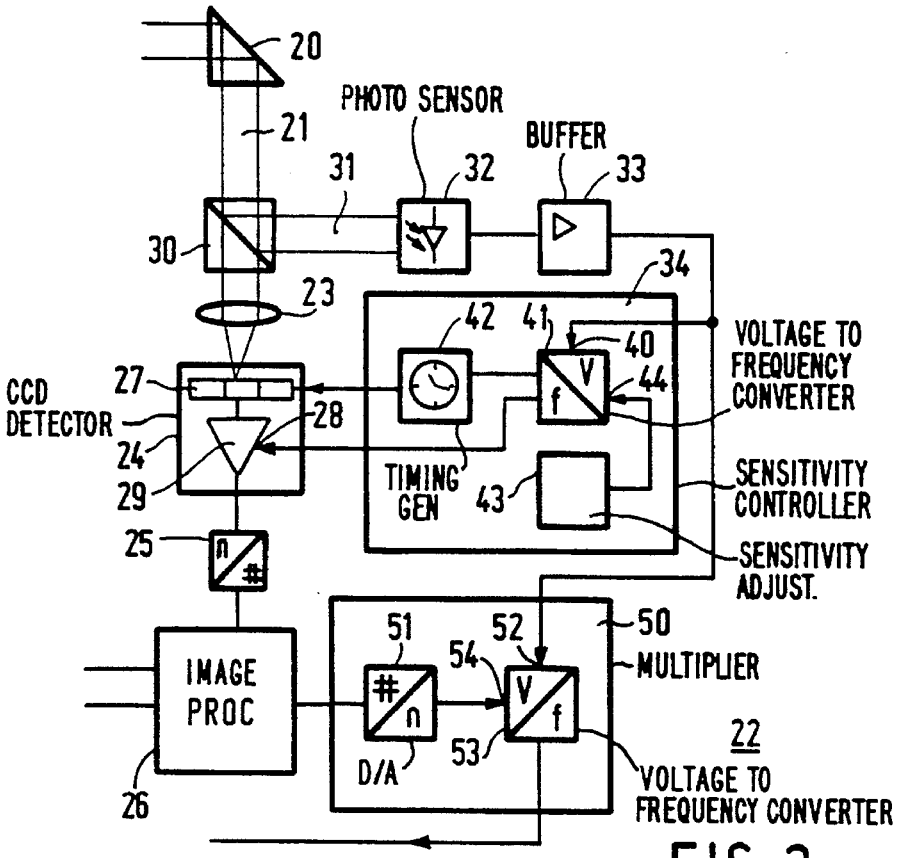
FIG. 2 shows a schematic diagram of details of an auxiliary light-detection system for use in an x-ray examination apparatus in accordance with the invention.

FIG. 2 shows a schematic diagram presenting details of an auxiliary light-detection system for use in an x-ray examination apparatus in accordance with the invention. The partial beam 21 that is deflected from the parallel beam 12 is, directed to a CCD-detector 24 by means of an optical imaging-system 23. Here, the optical system 23 is shown as a single lens with which substantially the entire visible image from the exit screen 5, is imaged in a reduced way, i.e. with only a part, viz. a per cent or less of its luminous intensity on a CCD-detector 24. A portion of the image formed on the CCD-detector is selected by disregarding signal amplitudes of the CCD-signal pertaining to parts of the visible image outside said portion to be selected. Such a selected image portion is employed as a measured-field, viz. by selecting a portion of the image, the CCD-detector provides an a photodetector signal in the form of an analog electronic CCD-signal due to brightness in said selected portion of the visible image. The analog electronic CCD-signal is converted by way of an analog-to-digital-converter 25 into a digital CCD-signal which is subsequently supplied to a digital image-processor 26.

Preferably, the optical imaging system 23 comprises a gradient index rod lens. Particularly, the gradient index rod lens is a rod lens having an index of refraction which varies parabolically along the radius of the cross section of the rod transverse to the longitudinal axis of the rod. As a result of the parabolic variation of the refractive index a ray incident on the front face of the gradient index rod lens follows a sinusoidal path along the rod lens. The period of this sinusoidal path is called the pitch of the rod lens. A quarter pitch rod lens is formed when the length of the rod is a quarter of the pitch of the rod lens. A quarter pitch rod lens focuses a parallel beam incident on the front face of the rod lens at the opposite face of the rod lens. The gradient index rod lens is for example a quarter pitch rod lens positioned with its face on which the parallel beam 21 is focused adjacent to the light-sensitive face of the CCD-chip 27. The use of a quarter pitch rod lens substantially reduces the size of the optical imaging system, because a quarter pitch rod lens has a rod length of about 1 mm or even less than 0.5 mm and the rod lens is positioned very close, within a mm, to the light-sensitive face of the CCD-chip 27. Moreover, the parallel beam is incident on only a few photosensitive elements, for instance 32×32, facing the face of the quarter pitch rod lens on which the parallel beam is focused. The time to read-out the few photosensitive elements is much shorter than the time to read-out the entire CCD-chip. As a result, the time to form the photodetector signal is reduced when a quarter pitch rod lens is incorporated in the optical imaging system 23.

A divisional beam 31 is deflected by way of a beam splitter 30, e.g. a second prism, from the partial beam 21. Said divisional beam 31 is impinging on a photosensor, notably a photodiode which generates an electronic photosensor signal having a signal amplitude due to the average brightness of the visible image. Said photosensor is supplied to a buffer-circuit 33. The sensitivity of the CCD-detector is adjusted by way of a sensitivity-controller 34. The photosensor signal is supplied to a first input-port 40 of a voltage-to-frequency-converter 41 which is incorporated in the sensitivity-control-device 34. The photosensor signal is converted by the voltage-to-frequency-converter into a digital sensitivity-control signal having a frequency being proportional to the signal amplitude of the photosensor signal. The sensitivity-control signal is supplied to a timing generator 42 being coupled to the CCD-chip 27 which is incorporated in the CCD-detector 24, for supplying a sensitivity-control signal employed for adjusting, substantially instantaneously, the integration time employed by the CCD-detector. Additionally or alternatively, the digital sensitivity-control signal is supplied to a control-input 28 of preamplifier 29 being incorporated in the CCD-detector 24. As a consequence, the sensitivity of the CCD-detector is adjusted reciprocally to the average brightness of the visible image. In other words when the average brightness of the visible image is high, the sensitivity of the CCD-detector is low and the dynamic range of brightness to which the CCD-detector is sensitive is located in a brightness-range so as to match the range of brightness-values of the visible image at issue. When on the other hand, in a subsequent visible image the average brightness is low, the sensitivity of the CCD-detector is, practically instantaneously, increased so as to sustain matching the sensitivity-range of the CCD-detector to the range of brightness of said subsequent visible image. Thus, brightness control is adequately carried out both for x-ray fluoroscopy where a patient is continuously irradiated with a low x-ray dose and for x-ray exposure where brief pulses of high x-ray dose are administered. Further refinement of the sensitivity controller 34 is achieved by providing a CCD-sensitivity-adjustment circuit 43 coupled to a second input-port 44 of the voltage-to-frequency-converter 41. By way of the CCD-sensitivity-adjustment circuit 43 an additional voltage is at option supplied to the voltage-to-frequency-converter which multiplies the frequency of the digital sensitivity-control signal by a supplementary factor of which the value can be chosen. In particular, by said CCD-sensitivity-adjustment circuit 43 matching of the auxiliary light-detection system to the x-ray image intensifier can be achieved.

The auxiliary light-detection system 22 is arranged for converting the digital CCD-signal into an exposure-control signal for controlling the x-ray source 1. To that end, the image processor 26 selects a relevant measured-field recorded by the CCD-detector and converts the digital CCD-signal into a primary control signal having a signal amplitude due to image-information of said selected portion, e.g. average brightness in said selected portion. Furthermore, because of the sensitivity of the CCD-detector being adjusted by the sensitivity controller 34 as described hereinbefore, the signal amplitude of the primary control signal is inversely proportional to the average brightness of the entire visible image formed on the exit screen of the x-ray image intensifier. Consequently, the primary control signal has a signal amplitude that is substantially independent of the average brightness of the visible image. As a result the CCD-signal only contains information about relative spatial intensity distribution within the visible image. In order to obtain an exposure-control signal that contains absolute information about the (spatial) intensity (distribution) within the image, an electronic multiplier 50 is provided, for multiplying the primary control signal by the photosensor signal. The photosensor signal is supplied to a first input-port 52 of a second voltage-to-frequency-converter 53. The primary control signal is converted into an analog control signal by a digital-to-analog-converter 51 and supplied to a second input-port 54 of the second voltage-to-frequency-converter 53. As an output, said voltage-to-frequency-converter 53 produces an exposure-control signal having a frequency due to the product of the signal amplitudes of the photosensor signal and the analog control signal. The exposure-control signal is supplied to respectively the high-voltage-generator 13 for controlling the x-ray source.

Often, the digital CCD-signal is only approximately proportional to the average brightness of the visible image. Deviations from exact inverse proportionality are induced by imperfections of the sensitivity-control-device 34. For each of the signal amplitudes of the CCD-signal of each of the pixels of the CCD-detector the deviation is substantially the same. Such deviations are corrected for in that by the image processor the average value is computed of the CCD-signal amplitudes from the pixels of the CCD-detector and that the by the image processor the digital CCD-signal is divided by said average value of CCD-signal amplitudes. Consequently, the ensuing primary control signal is exactly inversely proportional to the average brightness of the visible image.

Furthermore, from the digital CCD-signal contour information is obtained by the image processor and converted into a contour-signal. The contour-signal is employed as an image-control-signal for adjusting the absorption filter arrangement 15 to be placed in correspondence with contours dividing bright parts of the image from dark parts and thus avoiding overexposure. The digital CCD-signal is representative for the visible image because the optical system 23 images a reduced version of the visible image on the CCD-detector. In addition, the image processor provides a contrast-signal being representative of the contrast of the visible image. The contrast-signal is supplied as a further image-control signal to a control-input 81 of a video processor 80, or alternatively to a control input 82 of an internal amplifier 83 of the video camera 8. The video processor 80 converts the video signal from the video camera 8 into a signal that is suitable for a monitor 16 and/or a buffer-circuit 17; from the buffer-circuit 17 the signal is forwarded to an image registering-device 19. Moreover, because the CCD-detector is adjusted rapidly, the generation of the contrast signal is completed within the duration of an x-ray exposure. Therefore, supplying the contrast-signal to the high-voltage generator is employed for adjusting the x-ray source during exposure on the basis of contrast coming about of the visible image.

Figure 3:
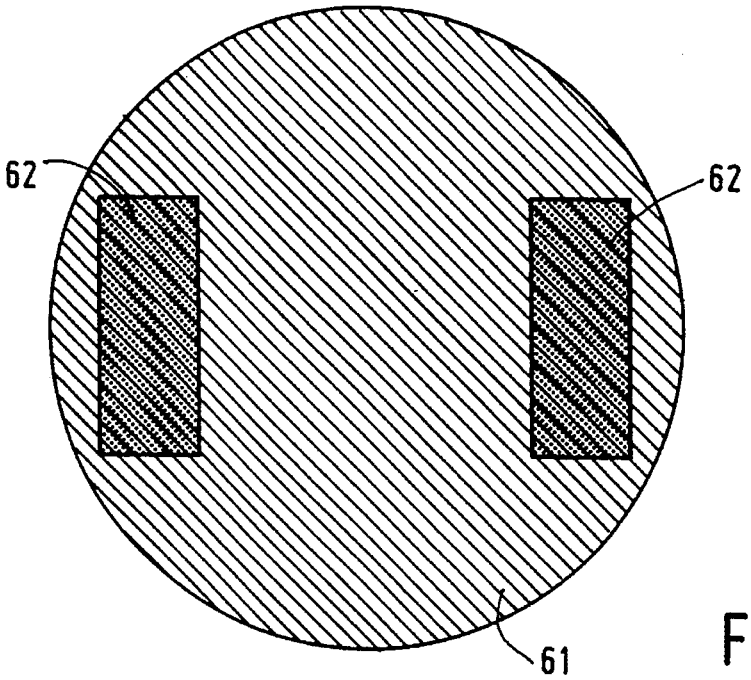
FIG. 3 shows an example of an area selected measured-fields in relation to the area of the exit screen of the x-ray image intensifier.

FIG. 3 shows an example of an area selected measured-fields in relation to the area of the exit screen of the x-ray image intensifier. The circumference of the substantially circularly shaped area of the exit screen of the x-ray image intensifier is indicated by the reference numeral 61. Preferably, the photosensor 32 is responsive to the entire area of the exit screen; thus the amplitude of the photosensor signal corresponds to the brightness of the visible image averaged over the shaded area 61. As an alternative, the amplitude of the photosensor an be chosen to correspond to the maximum brightness value within the area of the exit screen; this alternative is to be preferred for avoiding overexposure at the expense of loss of image quality in poorly illuminated parts. Cross-hatched areas 62 are shown as an example of selected measuring-fields, here in particular suited for brightness control for peripheral x-ray examinations. Viz. the exposure-control signal generated by the auxiliary light-detection-system 22 is due to assembling brightness-values in the areas 62, wherein relevant medical image information is present. Measuring-fields can also be selected in an intelligent manner, viz. by registering black-fields or white-fields, i.e. parts of the visible image having respectively very low or very high brightness, by the image processor 26 using the digital CCD-signal. These black-fields pertain to parts where x-ray absorption is exceptionally high, such as in pins employed for joining fractured bones. Black fields having been identified, they can be excluded from measuring-fields from which control signals are formed.

Furthermore, for controlling the imaging circumstances as determined inter alia by the adjustments of the high-voltage-generator 13 and the filter controller in such a manner that an displayed image on the monitor 16 or a recorded image registered in the image-registering device 19 approximate closely the image quality desired by a physician the image processor is provided with fuzzy logic. By means of fuzzy logic it is also possible to select intricately shaped measuring fields such as e.g. a contour of a patients hand. Controlling of the auxiliary light-detection system is discussed hereinbefore with reference to FIG. 1. For selection of measured-fields a user-interface 70 is provided. To that end the user-interface incorporates a video-mixer 71 having as an input the video signal generated by the television camera 8. A relevant measured-field can be selected from a monitor 72 and using on input device 73, here shown in the form of a joy-stick and a field-selection signal is subsequently supplied by the video-mixer 71 to the image-processor 26. Alternatively, said input device 73 may have the form of an anatomic programmed radiography (APR)-keyboard, having preprogrammed keys for selecting a measuring-field suitable for an anatomic region at issue. In addition, a field-memory 74 is provided from which field-selection signals can be supplied to the image processor 26. Selection of fields from the field-memory 74 is performed either manually by way of the input device 73 or automatically by way of a microprocessor 75.

I claim:

1. An x-ray examination apparatus comprising an x-ray source, an x-ray image intensifier for converting an x-ray image made by irradiating an object with an x-ray beam from the x-ray source into a visible image and an image detection device for detecting said visible image, the image detection device being provided with an auxiliary light-detection system for performing brightness-control for said visible image, said system comprising a photodetector for generating a photodetector signal, characterised in that the auxiliary light detection system incorporates a photosensor for generating a photosensor signal being representative of an average brightness of the visible image, and a sensitivity-control device for converting said photosensor signal into a sensitivity-control signal for adjusting the sensitivity of the photodetector.

2. An x-ray examination apparatus as claimed in claim 1, characterised in that the auxiliary light-detection system comprises an image processor for converting said photodetector signal into a primary control signal for performing said brightness-control by performing imaging adjustments.

3. An x-ray examination apparatus as claimed in any one of the preceding claims, characterised in that the sensitivity-control device incorporates a voltage-to-frequency converter and a timing generator.

4. An x-ray examination apparatus as claimed in claim 2, characterised in that the auxiliary light-detection system comprises multiplication means for forming an exposure-control signal for performing said brightness control, said exposure-control signal being formed by multiplying said primary control signal by said photosensor signal.

5. An x-ray examination apparatus as claimed in claim 4, characterised in that said multiplication means incorporates a digital-to-analog converter for converting said primary control signal into an analog control signal, and a voltage-to-frequency converter having a first input to which said analog control signal is taken, having a second input to which said photosensor signal is taken, having an output from which said exposure-control signal for performing brightness control is supplied.

6. An x-ray examination apparatus as claimed in claim 2, characterised in that said apparatus is provided with a user-interface for supplying a field-selection signal to the auxiliary light-detection system.

7. An x-ray examination apparatus as claimed in claim 2, characterised in that the image processor is arranged for supplying image-control signals.

8. An X-ray image detection system for detecting an X-ray image made by irradiating an object with an X-ray beam, said detection system comprising image conversion means for converting said X-ray image into a visible image, photodetector means for detecting said visible image, and an auxiliary light-detection system which incorporates a photosensor means for generating a photosensor signal and a sensitivity-control device for converting said photosensor signal into a sensitivity-control signal for adjusting the sensitivity of the photodetector means.

9. An x-ray examination apparatus as claimed in claim 3, characterized in that the auxiliary light-detection system comprises multiplication means for forming an exposure-control signal for performing said brightness control, said exposure-control signal being formed by multiplying said primary control signal by said photosensor signal.

10. An x-ray examination apparatus as claimed in claim 9, characterized in that said multiplication means incorporates a digital-to-analog converter for converting said primary control signal into an analog control signal, and a voltage-to-frequency converter having a first input to which said analog control signal is taken, having a second input to which said photosensor signal is taken, having an output from which said exposure-control signal for performing brightness control is supplied.

11. An x-ray examination apparatus as claimed in claim 3, characterized in that said apparatus is provided with a user-interface for supplying a field-selection signal to the auxiliary light-detection system.

12. An x-ray examination apparatus as claimed in claim 4, characterized in that said apparatus is provided with a user-interface for supplying a field-selection signal to the auxiliary light-detection system.

13. An x-ray examination apparatus as claimed in claim 5, characterized in that said apparatus is provided with a user-interface for supplying a field-selection signal to the auxiliary light-detection system.

14. An x-ray examination apparatus as claimed in claim 9, characterized in that said apparatus is provided with a user-interface for supplying a field-selection signal to the auxiliary light-detection system.

15. An x-ray examination apparatus as claimed in claim 10, characterized in that said apparatus is provided with a user-interface for supplying a field-selection signal to the auxiliary light-detection system.

16. An x-ray examination apparatus as claimed in claim 2, characterized in that the image processor is arranged for supplying image-control signals.

17. An x-ray examination apparatus as claimed in claim 3, characterized in that the image processor is arranged for supplying image-control signals.

18. An x-ray examination apparatus as claimed in claim 4, characterized in that the image processor is arranged for supplying image-control signals.

19. An x-ray examination apparatus as claimed in claim 5, characterized in that the image processor is arranged for supplying image-control signals.

20. An x-ray examination apparatus as claimed in claim 15, characterized in that the image processor is arranged for supplying image-control signals.

* * * * *